United States Patent [19]

Bassist

[11] 4,372,132

[45] Feb. 8, 1983

[54] APPARATUS FOR FEEDING FILLING THREADS TO A WRAP KNITTING MACHINE

[76] Inventor: Rudolph G. Bassist, 1003 McGrann Blvd., Lancaster, Pa. 17601

[21] Appl. No.: 214,353

[22] Filed: Dec. 8, 1980

[51] Int. Cl.[3] ..... D04B 27/10

[52] U.S. Cl. ..... 66/84 A

[58] Field of Search ..... 66/84 A, 85 A, 125

[56] References Cited

U.S. PATENT DOCUMENTS

| | | | |
|---|---|---|---|
| 3,523,432 | 8/1970 | Vajda et al. | 66/85 A |
| 3,636,731 | 1/1972 | Jones | 66/84 A |
| 3,681,942 | 8/1972 | Bassist | 66/84 A |
| 3,705,503 | 12/1972 | Skopalik et al. | 66/84 A |
| 3,707,083 | 12/1972 | Svoboda et al. | 66/125 R |
| 3,785,175 | 1/1974 | Kamp | 66/84 A |
| 3,967,469 | 7/1976 | Hepperle | 68/84 |
| 4,123,920 | 11/1978 | Bassist | 66/84 A |

*Primary Examiner*—Ronald Feldbaum

*Attorney, Agent, or Firm*—Alan H. Levine

[57] ABSTRACT

First and second spaced apart conveyors, extending toward the knitting instrumentalities of a knitting machine, each carry a plurality of thread clamping means. At least two guide means move from the first conveyor to the second conveyor and draw filling threads from filling thread supplies to positions adjacent to but spaced from the clamping means of both conveyors. The guide means then introduce the filling threads simultaneously into the clamping means of both conveyors. The clamping means of both conveyors then close simultaneously, the filling threads extending from the first conveyor to the rearward guide means are severed, and the forward guide means releases the filling threads. Continued movement of the rearward guide means draws new lengths of filling threads from the thread supplies. Each guide means comprises a carriage and a body, the body being movable toward the conveyors to introduce filling threads into the clamping means of the conveyors.

11 Claims, 10 Drawing Figures

APPARATUS FOR FEEDING FILLING THREADS TO A WRAP KNITTING MACHINE

This invention relates to wrap knitting machines, and more particularly to such machines capable of knitting fabric incorporating filling threads extending across the width of the fabric.

U.S. Pat. No. 3,680,332 discloses an apparatus for feeding filling threads to a knitting machine, from relatively stationary supplies, so that the filling threads become a permanent part of the knit fabric. In that apparatus, first and second spaced apart conveyors, each of which may be an endless chain, carry a plurality of thread clamping means. A guide means moves between the two conveyors, and pulls filling threads from the relatively stationary supplies. A plurality of first conveyor clamping means are operated simultaneously, as the guide means crosses them, to clamp the filling threads ends. Filling threads are drawn from the first conveyor to the second as the guide means moves, and a plurality of second conveyor clamping means are operated simultaneously as the guide means crosses them, to clamp the filling threads. Thereafter, the filling threads are cut between the second conveyor and the guide means. The conveyors then move the filling threads to the knitting instrumentalities of the knitting machine, while the guide means returns to its original position and begins a new cycle by again inserting filling threads into clamping means of the first conveyor.

In the apparatus of the patent, filling threads move along a complex path as they pass from the supplies, through eyelets on a long arm which swings over the path of travel of the guide means, then through two series of eyelets on the guide means, and finally to the first conveyor clamping means, during movement of the guide means from the first to the second conveyor. Furthermore, since the filling threads are held by the first conveyor clamping means during movement of the guide means to the second conveyor, the path of movement of the guide means must be at an acute angle to the direction of movement of the conveyors, so that by the time the threads are clamped in both conveyors, they are perpendicular to the path of movement of the conveyors. In addition, since only a single guide means is used, which draws no filling threads from the supplies during the return movement to its starting position, no filling threads are drawn into the apparatus for more than one-half of each cycle of the guide means.

It is an object of the present invention to provide an apparatus for feeding filling threads, of the general type described above, wherein during movement of the guide means from the first conveyor to the second conveyor, the filling threads are gripped by clamping means carried by the conveyor, and not by the clamping means of the first conveyor, whereby the filling threads can follow a straighter path as they are being drawn from the supplies.

It is another object of the invention to provide such an apparatus wherein two guide means are used for simultaneously inserting the filling threads into the clamping means of both conveyors, whereby the path of travel of the guide means can be perpendicular to the direction of movement of the conveyors. As a result, the apparatus can be made to occupy less space than a comparable apparatus made according to the patent mentioned above.

It is a further object of the invention to provide such an apparatus wherein at least two guide means are employed, so that upon completion of the insertion of filling threads into the conveyor clamping means, the rearward of the two guide means immediately begins drawing new filling threads from the supplies. As a result, for a given speed of movement of the conveyors, fewer filling threads need be drawn by the guide means during each pass across the conveyors, and hence the apparatus can be made smaller than the apparatus of the patent, or if the same number of filling threads are handled during each pass, the conveyors can be operated at faster speed.

The manner in which these and other objectives are achieved, as well as additional features and advantages of the invention, will be apparent from the following description in which reference is made to the accompanying drawings.

Figure 1:
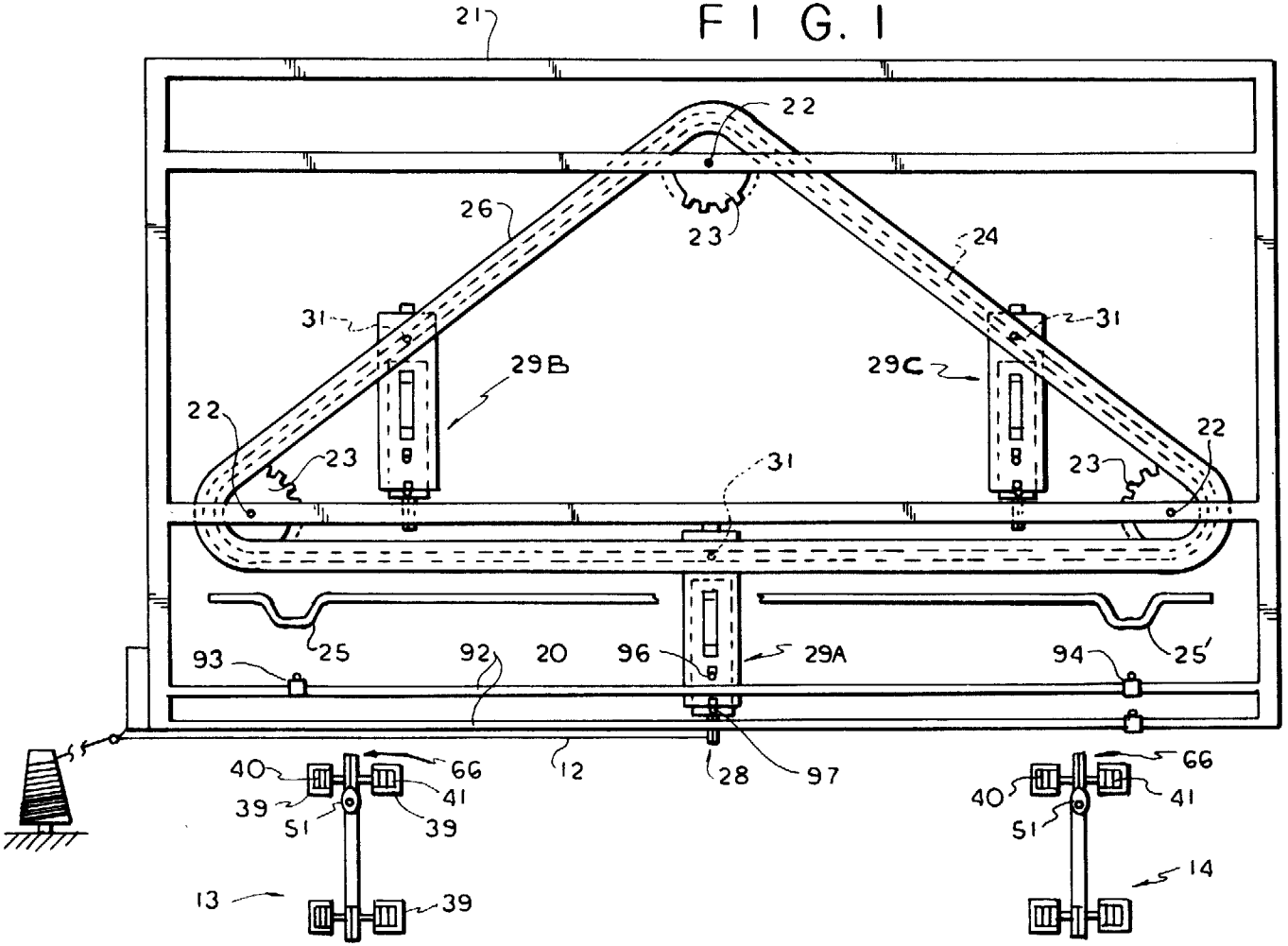
FIG. 1 is a vertical cross-sectional view through the first and second conveyors, looking in the direction of the knitting machine, and showing a filling thread guide means.

FIG. 1 illustrates a first conveyor 13 and a second conveyor 14, each having a top run and a bottom run. The conveyors are spaced apart a distance slightly exceeding the width of the needle bed of the knitting machine (not shown), i.e., the width of the knitted fabric produced by the machine. The conveyors move continuously when the knitting machine is in operation. As viewed in FIG. 1, the top run of each conveyor moves away from the viewer (and toward the knitting machine), and the bottom run of each conveyor moves toward the viewer.

Each conveyor 13 and 14 carries a plurality of thread clamps 66, which will be described in more detail below, and which are shown and described in detail in U.S. Pat. No. 4,123,920. The filling threads 12 are introduced into the conveyor clamps by thread guide means, three such thread guide means 29A, 29B, and 29C (FIG. 1) being employed in the present illustration. Arranged above and perpendicular to conveyors 13 and 14 are a pair of rectangular stationary frames 21 (only one being visible in FIG. 1). Each frame carries three stub shafts 22, each of which rotatably supports a sprocket wheel 23. An endless conveyor chain 24 is trained about the sprocket wheels 23 of each frame 21; thus, two conveyor chains 24 are carried by frames 21. A fixed triangular support 26 (see also FIG. 2) having a channel-shaped cross-section, may be provided to support each chain. One stub shaft 22 of each conveyor chain is connected by a suitable transmission (not shown) to the main drive shaft of the machine so as to move the chains 24 in such a way that the lower run of each chain moves from the left toward the right in FIG. 1, i.e., from filling thread conveyor 13 toward filling thread conveyor 14. The purpose of the chains 24 is to move the thread guide means 29A–C between conveyors 13 and 14.

Each thread guide means is illustrated as an inverted U-shaped carriage 30 (see also FIG. 2) arranged between frames 21, and having a pin 31 projecting from each side. Each pin 31 is pivotally connected at its end to one of the chains 24. Thus, at a time when the portion of the chain to which each pin 31 is connected is in the lower run of the chain, as shown in the drawings, carriage 30 is moving from conveyor 13 toward conveyor 14. After passing over the latter, carriage 30 moves around the sprocket wheels 23 and back toward conveyor 13. After passing over the latter conveyor, carriage 30 moves around the opposite sprocket wheels 23 and its direction of movement is again reversed.

Figures 2, 10:
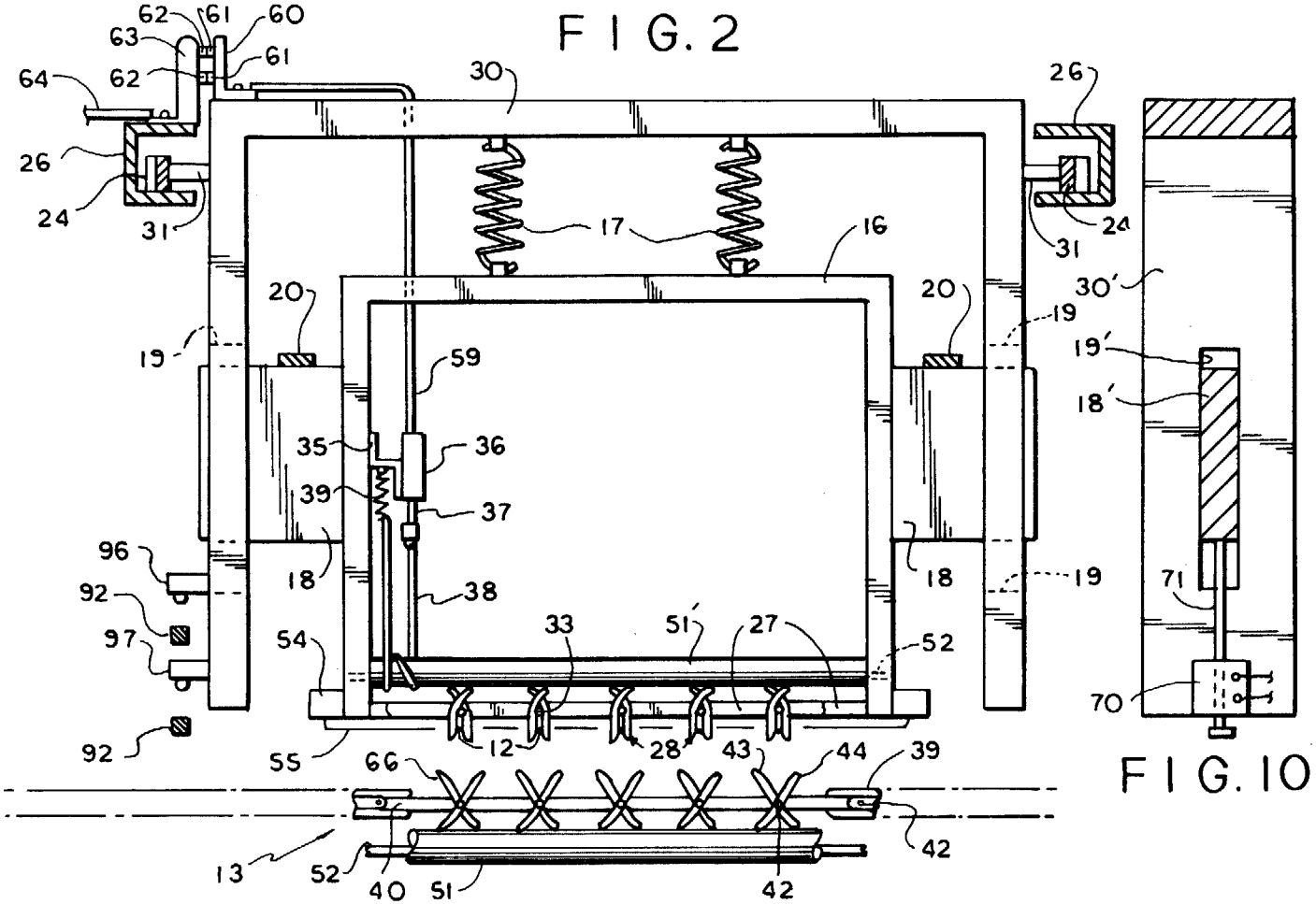
FIG. 2 is a front view of the guide means and the first conveyor, looking from the right in FIG. 1.
FIG. 10 is a vertical cross-sectional view through the carriage of a guide means showing an alternative embodiment of the invention.

As shown in FIG. 2, arranged within carriage 30 is an inverted U-shaped body 16, the body being suspended from the top wall of carriage 30 by a pair of coil springs 17. A pair of ears, or cam followers, 18 project laterally from body 16 and are slidably accommodated within vertical slots 19 in the vertical arms of carriage 30. The upper surfaces of followers 18 are slidably maintained in contact with the lower faces of two cam bars 20 (see also FIG. 1), fixed with respect to frames 21, by springs 17. Each cam bar 20 is straight and horizontal, except that to the left of conveyor 13 and to the right of conveyor 14, it protrudes downwardly, as indicated at 25 and 25'.

Extending between the lower ends of the vertical arms of body 16 are a pair of spaced-apart horizontal bars 27 (see also FIG. 4) between which are mounted a plurality of thread clamps 28. The number of clamps 28 is equal to the number of individual filling threads 12 which are to be applied simultaneously to the conveyors 13 and 14 during each pass of a carriage 30 from conveyor 13 to conveyor 14. Theoretically, any number of filling threads can be applied, for example, 72 filling threads may be simultaneously applied to the conveyors.

Each conveyor 13 and 14 comprises two parallel endless chains 40 and 41 (FIGS. 1–4) spaced apart horizontally, each chain being formed of a plurality of articulated links. Each chain 40 and 41 is slidably supported within a stationary channel-shaped support 39, the open sides of the supports facing each other. The links of each chain 40 and 41 are pivoted together on pins 42 (FIGS. 2–4) which extend horizontally between the two chains. Each pin 42 also serves as the pivot pin of one of the thread clamps 66.

Figure 4:
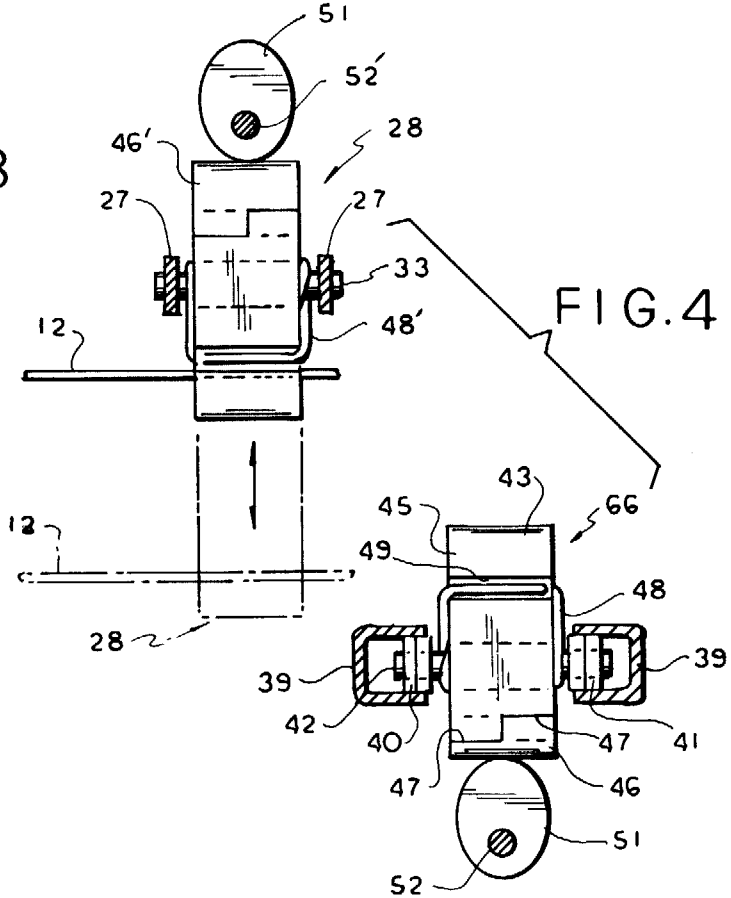
FIG. 4 is a view looking from the left in FIG. 3.
Figure 3:
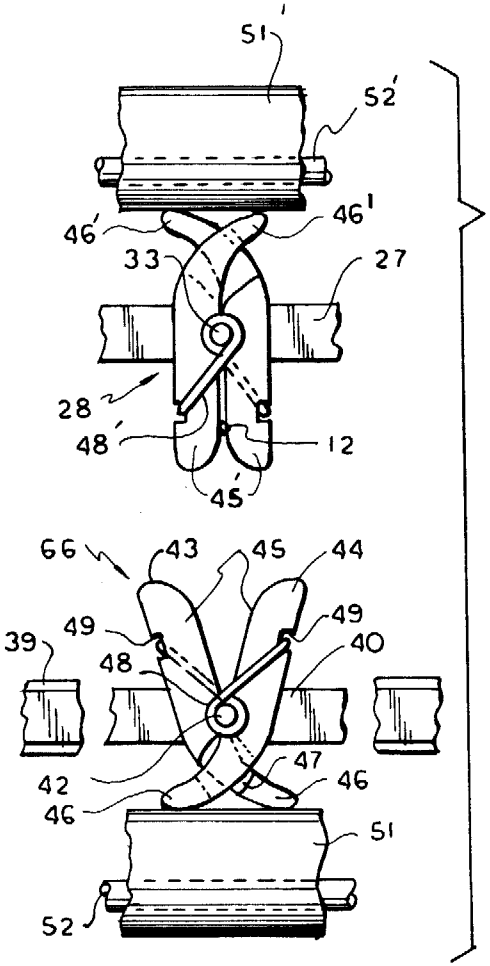
FIG. 3 is a fragmentary view, on an enlarged scale, of a portion of FIG. 2.

As best seen in FIGS. 2–4, each thread clamp 66 comprises two identical clamping members 43 and 44 pivotally arranged with respect to each other about pin 42. Each clamping member has a thread clamping arm portion 45 above pin 42 and a leg portion 46 below pin 42, the leg portion being curved toward the horizontal. Each leg portion 46 is formed with a rectangular notch 47 extending from one side of the clamping member to its vertical centerline. The two clamping members 43 and 44 are assembled by interengaging their corresponding notched portions with pin 42 between the clamping members. Also between the clamping members is a coil spring 48 surrounding pin 42, the ends of the spring being bent at right angles so that they seat in grooves 49 in the outer faces of clamping members 43 and 44. Spring 48 constantly urges arms 45 of clamping members 43 and 44 toward each other into thread clamping relationship, i.e., the condition of clamps 28 in FIG. 3.

Located beneath the upper run of each conveyor 13 and 14, in the region between frames 21, is a thread clamp actuator, shown in FIGS. 1 and 2 but best seen in FIGS. 3 and 4. The actuator includes a cam 51 elongated in the direction of movement of its respective conveyor, the length of the cam being sufficient to simultaneously engage, in the present example, 72 clamps 66. Cam 51 is eccentrically mounted for rotation about its longitudinal axis on a shaft 52 having a stationary horizontal axis. When cam 51 is positioned with its larger lobe between shaft 52 and clamps 66, the cam surface engages and spreads leg portions 46 of clamping members 43 and 44, as shown in FIG. 3, thereby spreading arm portions 45, against the force of spring 48, to open the clamp. In this way, all the clamps engaged by the cam are opened simultaneously. When cam 51 rotates 180° about the axis of shaft 52, to bring its smaller lobe between shaft 52 and clamps 66, spring 48 is permitted to bring arm portions 45 of clamping members 43 and 44 together into thread clamping relationship.

Thread clamps 28 carried by body 16 of each guide means are substantially identical to clamps 66, and are best seen in FIGS. 2–4. The portions of clamp 28 corresponding to those of clamp 66 bear the same reference numerals followed by a prime. Each thread clamp 28 comprises two identical clamping members 43' and 44' pivotally arranged with respect to each other about a pin 33. Pins 33 extend between horizontal bars 27 carried by body 16. Elongated cam 51', engaging the leg portions 46' of all the clamps 28, is eccentrically mounted on a shaft 52', the ends of which are supported by the vertical arms of body 16.

A bracket 35, fixed to a vertical arm of body 16, carries an electrical solenoid 36 having an armature 37. One end of a flexible, but inelastic, cable 38 is secured to armature 37; the cable is wrapped several turns around cam 51', and the other end of the cable is attached to one end of a coil spring 39, the other end of which is fixed to bracket 35. Electrical wires 59 extend from solenoid 36 to an angle bracket 60 mounted on carriage 30, the bracket carrying two electrical contacts 61 which can slidably engage two contacts 62 carried by an angle bracket 63 fixed to support 26. Electrical power, for energizing solenoid 36, is brought to contacts 62 by conductors 64.

Extending outwardly from the lower ends of the vertical arms of body 16 are two blocks 54, and extending between the blocks is an electrical resistance wire 55. Wire 55 is connectable to a source of electric power by means (not shown) similar to wire 59 and contacts 61 and 62, and when so energized instantly heats up to a temperature sufficient to sever any threads which may be in contact with the wire. All the filling threads 12 gripped by clamps 28 are in contact with cutting wire 55.

Operation of cams 51 and 51' and energization of cutting wire 55 may be controlled by movement of the guide means 29A–C. Fixed to one of the frames 21 are two switch actuator support bars 92 (FIG. 1) carrying electrical switch actuators 93 and 94. Two switches 96 and 97 (see also FIG. 2) are carried by each carriage 30, and positioned to be operated by actuators 93 and 94.

When guide means 29A is between conveyors 13 and 14, and moving toward conveyor 14 (FIG. 1), cam 51' carried by that guide means is positioned as shown in FIG. 3 so that the clamps 28 carried by that guide means are closed by springs 48'. As a result, these clamps grip filling threads 12 and draw them from supplies 57. At the same time, cams 51 of both conveyors 13 and 14 are in the position shown in FIG. 3 so that clamps 66 carried by the conveyors are open. The clamps 28 of guide means 29B, which follows guide means 29A are also open at this time.

Figure 5:
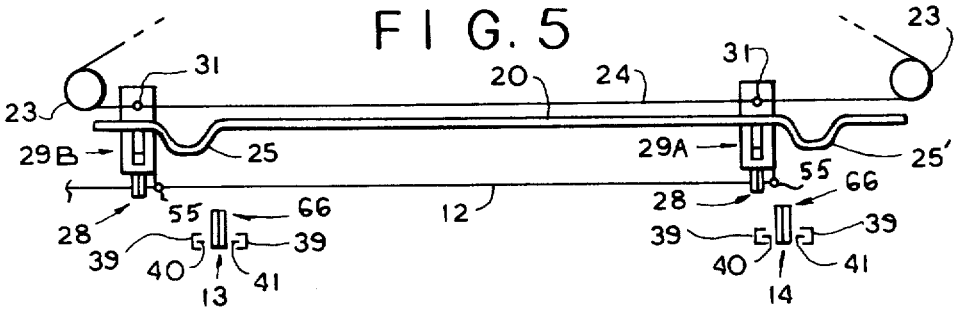
FIGS. 5–9 are schematic views illustrating the sequence of operation of the guide means.
Figure 6:
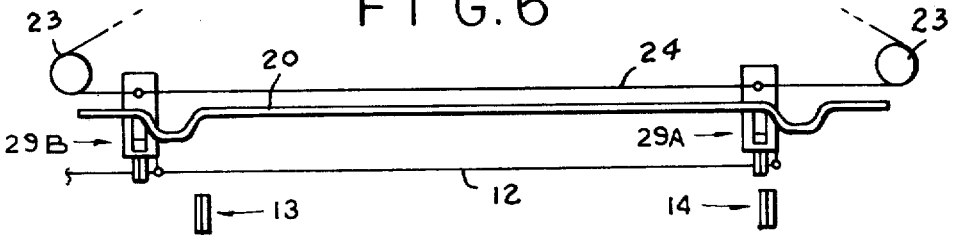
Figure 7:
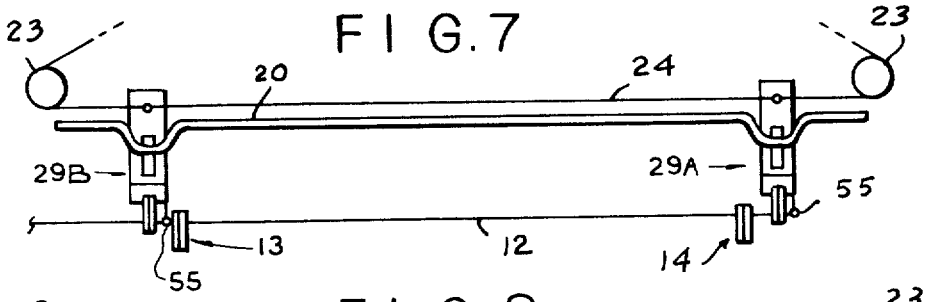

As movement of conveyor chain 24 continues, guide means 29B moves into horizontal alignment with guide means 29A (FIG. 5) and each of its open clamps straddles one of the filling threads 12. Upon further movement, guide means 29A passes over conveyor 14 (FIG. 6) while guide means 29B is still to the left of conveyor 13. Continued movement of the guide means brings followers 18 of guide means 29B into engagement with protrusions 25 of cam bars 20 and followers 18 of guide means 29A into engagement with protrusions 25' (FIG. 7). Consequently, the bodies 16 of both guide means move downwardly, stressing springs 17, toward conveyors 13 and 14 and insert the filling threads into the open clamps 66, one filling thread being inserted into each clamp. This is illustrated in broken lines in FIG. 4.

Upon downward movement of body 16 of guide means 29B, switches 96 and 97 of that guide means are activated by actuators 93. Operation of switch 96 causes solenoid 36 to be energized, in response to which armature 37 pulls cable 38, against the force of spring 39, and rotates cam 51' 180° to the position shown in FIGS. 2 and 3. As a result, clamps 28 close and grip filling threads 12. Operation of switch 96 also causes a quick 180° rotation of both cams 51, from the position shown in FIGS. 2 and 3 to a position wherein their smaller lobes engage clamps 66 of both conveyors, thereby allowing clamps 66 to close and grip the filling threads 12. Rotation of each cam 51 may be effected by a solenoid (not shown). Operation of switch 97 causes wire 55 to be heated, whereby it severs all the filling threads in the region between guide means 29B and conveyor 13. After severance, the newly cut lengths of filling thread remain gripped in the clamps 66 of conveyors 13 and 14, for delivery to the knitting machine, and the newly cut ends extending to the filling thread supplies remain gripped by clamps 28 of guide means 29B.

Figure 8:
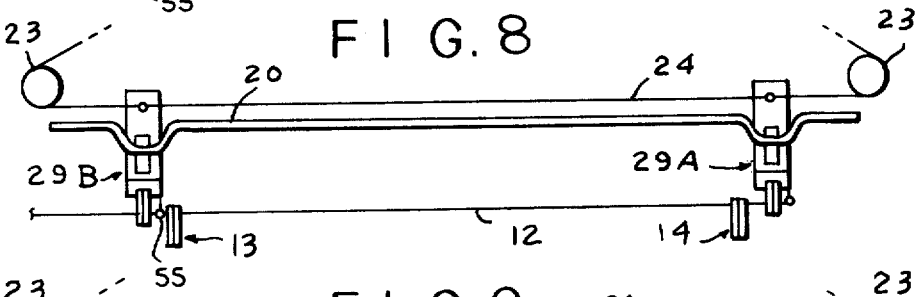
Figure 9:
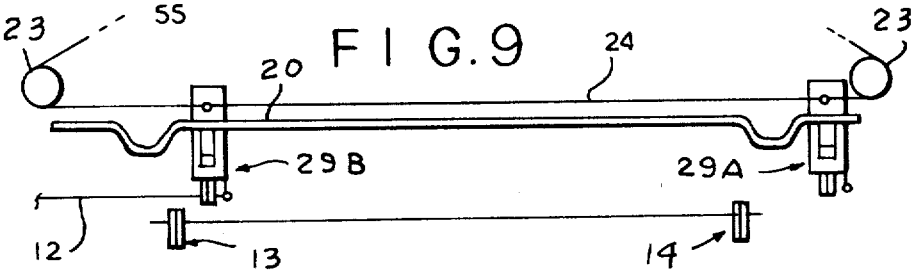

At the time of downward movement of body 16 of guide means 29A, switch 96 of that guide means is actuated by actuator 94. As a result, solenoid 36 of that guide means is deenergized, allowing spring 39, through cable 38, to rotate cam 51' to the position of wherein its large lobe engages clamps 28 and opens them (FIG. 8). Upon continued movement of conveyor chain 24, the bodies 16 of both guide means rise again (FIG. 9) as their followers 18 leave protrusions 25,25', and guide means 29B draws filling threads from the supplies toward conveyor 14. During this next cycle, guide means 29B will behave as described above with reference to guide means 29A, and guide means 29C will move to the position previously occupied by guide means 29B. In this way, another group of filling threads will be inserted into the conveyor clamps 66 by guide means 29B and 29C.

If desired, cam bars 20 can be eliminated, and downward movement of body 16 effected electrically. As shown in FIG. 10, a solenoid 70 may be mounted on the inner surface of the vertical arm of each carriage 30, the armature 71 of the solenoid being attached to an ear 18 of body 16. Upon enerization of the solenoid, ears 18, and hence body 16, are pulled downwardly toward conveyors 13 and 14. Operation of solenoid 70 may be controlled by a switch on carriage 30 actuated by an actuator on one of the bars 92.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

I claim:

1. Apparatus for feeding filing threads to a warp knitting machine comprising:

first and second spaced apart conveyor means extending toward the knitting instrumentalities of the machine, a plurality of thread clamping means carried by and movable with each of said conveyor means, a plurality of filling thread supplies, at least two guide means, each movable from the first conveyor means to the second conveyor means, for drawing filling threads from the thread supplies to positions adjacent to but spaced from the clamping means of both conveyor means, the two guide means being spaced apart in the direction of their movement, each of the guide means including a carriage and a body carried by, and movable with respect to, the carriage, means mounted on the body for gripping the filing threads, and means for moving the body with respect to the carriage toward the conveyor means for inserting the filling threads into the clamping means of the conveyor means.

2. Apparatus as defined in claim 1 wherein the two guide means are spaced apart or distance greater than the spacing between the first and second conveyor means.

3. Apparatus as defined in claim 1 including three guide means, and means for moving all three guide means along the same continuous path, the three guide means being equidistantly spaced apart along the path.

4. Apparatus as defined in claim 1 wherein the clamping means of the conveyor means are open prior to introduction of the filling threads into them, and actuating means for simultaneously closing the clamping means of both conveyor means to grip the filling threads introduced into them.

5. Apparatus as defined in claim 4 including means for severing the filling threads extending from the first conveyor means to the one of the guide means which is rearward of the other, considering the direction of movement of the guide means, immediately after closing of the clamping means carried by the conveyor means.

6. Apparatus as defined in claim 5 wherein the clamping means carried by the rearward guide means the filling threads near their cut ends, so that continued movement of that guide means draws new lengths of filling threads from the thread supplies.

7. Apparatus as defined in claim 4 wherein the filling threads are gripped by the clamping means of both guide means immediately prior to insertion of the filling threads into the clamping means of the conveyor means, and actuating means for opening, immediately after the clamping means of the conveyor means close, the clamping means of only the one of the guide means which is forward of the other considering the direction of movement of the guide means, the clamping means of the rearward guide means remaining closed.

8. Apparatus as defined in claim 1 wherein said means for gripping the filling threads are clamping means similar to the thread clamping means carried by the conveyor means, each clamping means mounted on the body serving to introduce a filling thread into one of the clamping means carried by one of the conveyor means.

9. Apparatus as defined in claim 1 wherein the means for moving the body with respect to the carriage includes at least one cam fixed with respect to the path of movement of each conveyor means, and at least one cam follower carried by the body, cooperation of the cam and follower, during movement of each guide means, causing movement of the body, with respect to the carriage, in a direction toward the conveyor means.

10. Apparatus as defined in claim 9 including resilient means between the body and carriage for returning the body in a direction away from the conveyor means after the filling threads have been inserted into the clamping means of the conveyor means.

11. Apparatus as defined in claim 1 wherein the means for moving the body with respect to the carriage includes an electrical solenoid, having an armature, operatively connected between the carriage and body, movement of the armature, upon energization of the solenoid, being transmitted to the body.

* * * * *